US005215841A

United States Patent [19]

Scharfe et al.

[11] Patent Number: 5,215,841

[45] Date of Patent: Jun. 1, 1993

[54] ELECTROPHOTOGRAPHIC IMAGING MEMBER WITH OVERCOATINGS CONTAINING FULLERENES

[75] Inventors: Merlin E. Scharfe, Penfield; Ronald F. Ziolo, Webster; Joseph Mammino; Donald S. Sypula, both of Penfield, all of N.Y.

[73] Assignee: Xerox Corporation, Stamford, Conn.

[21] Appl. No.: 814,548

[22] Filed: Dec. 30, 1991

[51] Int. Cl.[5] ..... G03G 5/047

[52] U.S. Cl. ..... 430/59; 430/58; 430/66; 430/900

[58] Field of Search ..... 430/58, 59, 66, 900

[56] References Cited

U.S. PATENT DOCUMENTS 4,515,882 5/1985 Mammino et al. ..... 430/58
4,922,827 5/1990 Remo ..... 102/496
5,114,477 5/1992 Mort et al. ..... 106/20
5,120,628 6/1992 Mammino et al. ..... 430/59
5,132,105 7/1992 Remo ..... 423/446

*Primary Examiner*—Roland Martin
*Attorney, Agent, or Firm*—Peter H. Kondo

[57] ABSTRACT

An electrophotographic imaging system utilizing a member comprising at least one photoconductive layer and an overcoating layer comprising a film forming continuous phase comprising charge transport molecules and charge injection enabling sites comprising finely divided fullerene particles, the insulating overcoating layer being substantially transparent to activating radiation to which the photoconductive layer is sensitive and substantially electrically insulating at low electrical fields.

20 Claims, No Drawings

ELECTROPHOTOGRAPHIC IMAGING MEMBER WITH OVERCOATINGS CONTAINING FULLERENES

BACKGROUND OF THE INVENTION

This invention relates to electrophotography and more particularly, to an improved overcoated electrophotographic imaging member and method of using the electrophotographic imaging member.

Electrophotographic imaging members include single or multiple layered devices comprising homogeneous or heterogeneous inorganic or organic compositions and the like. One example of a photoconductive member containing a heterogeneous composition is described in U.S. Pat. No. 3,121,006 wherein finely divided particles of a photoconductive inorganic compound are dispersed in an electrically insulating organic resin binder. Homogeneous single layer devices are well known and usually contain selenium or selenium alloys. The surfaces of selenium type photoreceptors are highly susceptible to stratches which print out in final copies.

Multiple layered photoresponsive devices comprising photogenerating layers and transport layers deposited on conductive substrates are also well known in the art and are extensively described in the patent literature, for example, in U.S. Pat. No. 4,265,990. These comprise a charge or photogenerating generating layer and a hole transport layer. Overcoated photoresponsive materials containing a hole injecting layer, a hole transport layer, a photogenerating layer and a top coating of an insulating organic resin, as described, for example, in U.S. Pat. No. 4,251,612. The disclosures of U.S. Pat. Nos. 4,265,990 and 4,251,612 are incorporated herein by reference in their entirety. Other representative patents containing layered photoresponsive devices include U.S. Pat. Nos. 4,115,116; 4,047,949 and 4,081,274. These patents relate to systems that require negative charging for hole transporting layers when the photogenerating layer is beneath the transport layer. Photogenerating layers overlying hole transport layers require positive charging but must be equal to or less than about 1 to 2 micrometers for adequate sensitivity and therefore wear away quite rapidly. While the above described electrophotographic imaging members may be suitable for their intended purposes, there continues to be a need for improved devices. For example, the imaging surface of many photoconductive members is sensitive to wear, ambient fumes, scratches and deposits which adversely affect the electrophotographic properties of the imaging member. Overcoating layers have been proposed to overcome the undesirable characteristics of uncoated photoreceptors. However, many of the overcoating layers adversely affect electrophotographic performance of an electrophotographic imaging member.

Overcoatings for photoreceptors have been disclosed in U.S. Pat. No. 4,515,882. These overcoatings comprise an insulating film forming continuous phase comprising charge transport molecules and finely divided charge injection enabling particles dispersed in the continuous phase. The imaging members have at least one photoconductive layer and the overcoating layer. Where desired, a barrier layer may be provided in the device interposed between the photoconductive layer and the overcoating layer. The devices disclosed in U.S. Pat. No. 4,515,882 can be employed in an electrophotographic imaging process in which the outer imaging surface of the overcoating layer is uniformly charged in the dark. A sufficient electric field is applied across the electrophotographic imaging member to polarize the charge injection enabling particles whereby the charge injection enabling particles inject charge carriers into the continuous phase of the overcoating layer. The charge carriers are transported to and trapped at the interface between the photoconductive layer, and opposite space charge in the overcoating layer is relaxed by charge emission from the charge injection enabling particles to the imaging surface. The overcoating layer is essentially electrically insulating prior to deposition of the uniform electrostatic charge on the imaging surface.

The mechanism by which charge passes through the overcoating to the photoreceptive surface in known devices is believed to involve the electric field, formed by corona charging of the electrophotographic device, instantly polarizing the charge injection enabling particles or species. Charge, for example, in the form of holes, is injected into the hole transport phase of the overcoating and is driven by the charging field to the interface between the overcoating and photoconductive layer. The charge is stopped at the interface by a blocking layer or because there is no injection into the photoreceptor. The negative space charge in the bulk of the overcoating is relaxed by a charge emission.

However, overcoatings such as those disclosed in U.S. Pat. No. 4,515,882 suffer from the disadvantage of relatively high light absorption and scattering in the coating due to pigment loading and particle size. Inorganic charge injection enabling particles mentioned in that patent include carbon black, molybdenum disulfide, silicon, tin oxide, antimony oxide, chromium dioxide, zinc dioxide, titanium oxide, magnesium oxide, manganese dioxide, aluminum oxides, colloidal silica, graphite, tin, aluminum, nickel, steel, silver, gold, other metals and their oxides, sulfides, halides and other salt forms, etc. Such charge injection enabling particles tend to reduce the photosensitivity of the photoreceptor. For example, one weight percent of carbon black pigment, which is a prime effective charge injection enabling species, reduces light transmission to the photosensitive layer by about 20 percent. Thus, the sensitivity of the photoreceptor is affected by absorption of some of the activating radiation absorbed by the components of the overcoating. Grinding of charge injection enabling particle to a small size for improved overcoating transparency is an extra processing step and very small particle sizes are difficult to achieve by grinding. Thus, there is a continuing need for a longer life photoreceptor having improved photosensitivity.

Although excellent toner images may be obtained with multilayered photoreceptors, it has been found that as more advanced, higher speed electrophotographic copiers, duplicators and printers are developed, photoreceptors having higher sensitivities are desired. There is also a great need for long service life photoreceptors having high photosensitivity.

INFORMATION DISCLOSURE STATEMENT

U.S. Pat. No. 4,515,882 to Mammino et al, issued May 7, 1985—An electrophotographic imaging device is disclosed which utilizes a member comprising at least one photoconductive layer and an overcoating layer comprising a film forming continuous phase comprising charge transport molecules and finely divided charge injection enabling particles dispersed in the continuous phase, the insulating overcoating layer being substantially transparent to activating radiation to which the photoconductive layer is sensitive and substantially electrically insulating at low electrical fields.

In copending U.S. patent application Ser. No. 07/448,855, entitled "TRANSPORT PHOTORECEPTOR OVERCOATINGS", filed Dec. 12, 1989, now U.S. Pat. No. 5,120,628, the entire disclosure of which is incorporated herein by reference, a highly transparent charge injection enabling species for electrophotographic overcoatings is described which includes copper (I) compounds dispersed throughout the overcoating or complexed into a charge transport matrix. The overcoatings contain an insulating, film forming continuous phase having charge transport molecules and the copper (I) compounds.

In copending U.S. patent application Ser. No. 0/7754,089, entitled "PHOTOCONDUCTIVE IMAGING MEMBERS", filed Jun. 3, 1991, the entire disclosure of which is incorporated herein by reference, photoconductive members are disclosed comprising a supporting substrate, a photogenerator layer optionally dispersed in a resin binder, and a charge transport layer comprising a fullerene or fullerenes optionally dispersed in a resin binder.

In copending U.S. patent application Ser. No. 07/709,734 entitled "TONER AND DEVELOPMENT COMPOSITIONS", filed Jun. 3, 1991, the entire disclosure of which is incorporated herein by reference, developer compositions and toner compositions are described comprising resin particles, and pigment particles comprising fullerences.

SUMMARY OF THE INVENTION

It is, therefore, an object of the present invention to provide an improved electrophotographic imaging member which overcomes the above-noted deficiencies.

It is yet another object of the present invention to provide an improved imaging member which has high photosensitivity It is still another object of the present invention to provide an improved imaging member having extended life during cycling.

The foregoing objects and others are accomplished in accordance with this invention by providing an electrophotographic imaging member having at least one photoconductive layer and an overcoating layer comprising an insulting film forming continuous phase comprising charge transport molecules and finely divided charge injection enabling sites comprising fullerene particles dissolved or dispersed in the continuous phase. Where desired, a barrier layer may be interposed between the photoconductive layer and the overcoating layer. This electrophotographic imaging member can be employed in an electrophotographic imaging process in which the outer imaging surface of the overcoating layer is uniformly charged in the dark, a sufficient electric field is applied across the electrophotographic imaging member to polarize the charge injection enabling particles whereby the charge injection enabling fullerene particles inject charge carriers into the overcoating layer, the charge carriers are transported to and trapped at the interface between the photoconductive layer and the overcoating layer, and opposite space charge in the overcoating layer is relaxed by charge emission from the charge injection enabling particles to the imaging surface. The overcoating layer is essentially electrically insulating prior to the deposition of the uniform electrostatic charge on the imaging surface.

Generally, the overcoating of this invention comprises an insulating film forming continuous phase comprising charge transport molecules and charge injection enabling sites comprising finely divided fullerene particles dissolved or dispersed in the continuous phase. Any suitable insulating film forming binder having a very high dielectric strength and good electrically insulating properties may be used in the continuous charge transporting phase of the overcoating of this invention. The binder itself may be a charge transporting material or one capable of holding transport molecules in solid solution or as a molecular dispersion. A solid solution is defined as a composition in which at least one component is dissolved in another component and which exists as a homogeneous solid phase. A molecular dispersion is defined as a composition in which particles of at least one component are dispersed in another component, the dispersion of the particles being on a molecular scale. Typical film forming binder materials that are not charge transporting material include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amide-imide), styrene-butadiene copolymers, vinylidenechloride-vinylchloride copolymers, vinylacetate-vinylidenechloride copolymers, styrene-alkyd resins, fluorocarbon resins, and the like.

Any suitable film forming polymer having charge transport capabilities may be used as a binder in the continuous phase of the overcoating of this invention. Binders having charge transport capabilities are substantially nonabsorbing in the spectral region of intended use, but are "active" in that they are capable of transporting charge carriers injected by the charge injection enabling particles in an applied electric field. The charge transport binder may be a hole transport film forming polymer or an electron transport film forming polymer. Charge transporting film forming polymers are well known in the art. A partial listing representative of aryl amine charge transporting film forming polymers are described in U.S. Pat. Nos. 4,818,650, 4,956,440, 4,806,444, 4,935,487, 4,806,443, 4,801,517 and 5,028,687. Other charge transporting polymers include polysilylenes disclosed, for example, in U.S. Pat. Nos. 4,618,551, 4,774,159, 4,772,525 and 4,758,488. Still other charge transporting polymers include polyvinylcarbazole and derivatives of Lewis acids described in U.S. Pat. No. 4,302,521 and vinyl-aromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Still other transport materials include poly-1-vinylpyrene, poly-9-vinylanthracene, poly-9-(4-pentenyl)-carbazole, poly-9-

(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516. The disclosures of each of the patents identified above pertaining to binders having charge transport capabilities are incorporated herein in their entirety.

The film forming binder should have an electrical resistivity at least about $10^{11}$ ohm-cm. It should be capable of forming a continuous film and be substantially transparent to activating radiation to which the underlying photoconductive layer is sensitive. In other words, the transmitted activating radiation should be capable of generating charge carriers, i.e. electron-hole pairs in the underlying photoconductive layer or layers. A transparency range of between about 35 percent and about 100 percent can provide satisfactory results depending upon the specific photoreceptors utilized. A transparency of at least about 50 percent is preferred for greater speed with optimum speeds being achieved at a transparency of at least 90 percent. Transparency is meant to refer to the property of permitting the passage of radiations in the spectral region at which the underlying photoconductive layer or layers are sensitive.

Any suitable charge transport molecule capable of acting as a film forming binder or which is soluble or dispersible on a molecular scale in a film forming binder may be utilized in the continuous phase of the overcoating of this invention. The charge transport molecule should be capable of transporting charge carriers injected by the charge injection enabling fullerene particles in an applied electric field. The charge transport molecules may be hole transport molecules or electron transport molecules. Where the charge transport molecule is capable of acting as a film forming binder as indicated above, it may be employed, if desired, to function as both an insulating binder for the charge injection enabling particles and as the continuous charge transporting phase without the necessity of incorporating a different charge transport molecule in solid solution or as a molecular dispersion therein. Non film forming charge transporting materials are well known in the art. A partial listing representative of well known non film forming charge transporting materials including diamines, pyrazolines, substituted fluorenes, oxidiazoles, hydrazones, tri-substituted methanes, transparent organic non-polymeric transport materials, and the like are disclosed in U.S. Pat. No. 4,515,882, the entire disclosure thereof being incorporated herein by reference.

When the charge transport molecules are combined with an insulating film forming binder, the amount of charge transport molecule which is used may vary depending upon the particular charge transport material and its compatibility (e.g. solubility) the continuous insulating film forming binder phase of the overcoating layer, and the like. Satisfactory results have been obtained using the proportions normally used to form the charge transport medium of photoreceptors containing a charge transport component and a charge generating component.

When overcoating layers are prepared with only insulating film forming binder and charge transport molecules in solid solution or molecular dispersion in the film forming binder, the overcoating layer remains electrically insulating after charging until at least the image exposure step. However, when sufficient charge injection enabling particles are dispersed in an overcoating layer containing an insulating film continuous phase capable of transporting charge carriers, the overcoating layer acquires the capability of being an insulator until a sufficient electric field is applied to polarize the charge injection enabling fullerene particles. Then the charge injection enabling fullerene particles inject charge carriers into the continuous phase of the overcoating layer. The charge carriers are transported to and trapped at the interface between the underlying photoconductive layer and the overcoating layer. Opposite space charge in the overcoating layer is relaxed by charge emission from the charge injection enabling particles to the outer imaging surface of the overcoating.

Any suitable charge injection enabling fullerene particle may be utilized in the overcoating of this invention. The fullerene particle can function as a charge injection enabling particle as long as the concentration of the fullerene particles and the entire electric field are sufficient to cause the charge injection enabling fullerene particles to rapidly polarize and inject charge carriers into the continuous phase of the overcoating layer. Any suitable charge injection enabling fullerene particles may be utilized in the overcoating of this invention. Fullerene charge injection enabling particles have an electrical resistivity of about $10^{12}$ ohm cm or less. Molecular fullerenes have been described as entirely closed, hollow spheroidal shells of carbon atoms containing 32 to 1,000 or more carbon atoms in each sphere, reference Smalley, R. E. "Supersonic Carbon Cluster Beams in Atomic and Molecular Clusters", Bernstein, E. R., Ed. and *Physical and Theoretical Chemistry*, Vol. 68, Elsevier Science: New York, 1990; pages 1 to 68, the entire disclosures of which are incorporated herein by reference. The prototypical fullerene, $C_{60}$, has been referred to as buckminsterfullerene and has the molecular geometry of a truncated icosahedron. Thus, the $C_{60}$ fullerene molecules resemble a molecular sized soccer ball, reference *Time Magazine*, May 6, 1991, page 66, *Science*, vol. 252, Apr. 12, 1991, page 646, and *Business Week*, Dec. 9, 1991, pages 76 and 77, the entire disclosures of which are incorporated herein by reference. Molecules of $C_{60}$, $C_{70}$ and of other fullerenes have also been referred to as buckyballs. Buckminsterfullerenes are usually comprised of $C_{60}$ molecules contaminated with small amounts of $C_{70}$ and possibly $C_{76}$ and $C_{84}$ molecules or even smaller amounts of higher molecular weight fullerene molecules. Still other fullerenes include $C_{82}$, $C_{88}$ and $C_{90}$ molecules. In addition to shapes such as the buckyballs, the fullerenes may have a tubular shape or helical configuration as described, for example, in *Business Week*, Dec. 9, 1991, pages 76 and 77. The preparation of buckminsterfullerene and of other fullerenes from contact arc vaporization of graphite as well as a number of buckminsterfullerene characteristics, such as solubility, crystallinity, color and the like, have been described in Kratschmer, W., Lamb, L. D., Fostiropoulos, K., Huffman, D. R., *Nature*, 1990, Vol. 347, pages 354 to 358 and in *Chemical and Engineering News*, Oct. 29, 1990, pages 22 to 25, the entire disclosures of which are incorporated herein by reference. The fullerenes are available from Texas Fullerenes Corporation, 2415 Shakespeare Suite 5, Houston, Tex. 77030-1038; Materials & Electrochemical Research (MER) Corporation, 7960 South Kolb Road, Tucson, Ariz. 85706; and Research Materials, Inc., 1667 Cole Boulevard, Golden, Colo. 80401, and are believed to be comprised of mainly $C_{60}$ and smaller amounts of $C_{70}$, $C_{76}$, $C_{84}$ and $C_{90}$ carbon molecules, and possible small amounts of other higher molecular weight fullerenes. Allotropic forms of carbon comprising spherical assemblies of carbon atoms $C_n$ with, for example, n being the number 60, 70, 76, 78, 82, 84, 90, 96, and the like are considered fullerenes and can be formed as powders by the evaporation of graphite in inert noble gas atmospheres with arcs or lasers, and these fullerenes are available from the sources mentioned herein. The color of the solid allotrope can depend on the value of n, for example when n is equal to 60 the color is mustard yellow and when n is equal to 70 the color is purple magenta. The expression "fullerene" or "fullerenes" as employed herein is intended to include all forms of the fullerenes illustrated herein, other known fullerenes, mixtures thereof in embodiments, and the like. Typical fullerenes include, for example those comprising $C_{60}$ carbon, $C_{70}$ carbon, $C_{84}$ carbon, $C_{234}$ carbon, $C_{340}$ carbon, or mixtures therof. Fullerenes can have a molecular weight of between about 384 and about 12,000. These fullerenes may be doped with any suitable dopant. Typical dopants include, for example, yttrium, lithium, lanthanum, potassium, cesium, rubidium, iodine, bromine, and the like. Unlike other known carbon forms, diamond and graphite and derivatives thereof, the fullerene forms of carbon possess solubility in organic solvents. This solubility in organic solvents enables improved processing and the economical preparation of compositions and forms overcoatings having substantially higher transparency than ordinary carbon black.

Generally, the dry overcoating layer should contain at least about 0.1 percent by weight of the fullerene charge injection enabling particles based on the total weight of the overcoating layer. At lower concentrations, a noticeable residual charge tends to form, which can be compensated during development by applying an electric bias as is known in the art. The upper limit for the amount of the charge injection enabling particles to be used depends upon the relative quantity of charge flow desired through the overcoating layer, but should be less than that which would reduce the transparency of the overcoating to a value less than about 35 percent and which would render the overcoating too conductive.

The amount of charge injection enabling particles which can be loaded in the overcoating layer of the present invention may range from about 0.1 to about 25 weight percent based on the total weight of the dry overcoating layer. The particular loading of charge injection enabling particles will depend on the desired percent transmission, desired electrical conductivity, the binding capability of the resin binder, the desired mechanical properties of the imaging member, e.g., flexibility, and the residual voltage on the photoreceptor. With fullerenes, the loading may be from about 1 to about 25 weight percent based on weight of the total weight of the dry overcoating layer. A particularly preferred loading of fullerenes is 1 to 20 weight percent and most preferably about 3 to 15 weight percent. With such loadings, transparent layers having a resistivity greater than about $10^{11}$ ohm-cm can be obtained.

The particle size of the charge injection enabling particles should be less than about 25 micrometers, preferably less than about 1 micrometer, and for molecular dispersions less than the wavelength of light utilized to expose the underlying photoconductive layers. In other words, the particle size should be sufficient to maintain the overcoating layer substantially transparent to the wavelength of light to which the underlying photoconductive layer or layers are sensitive. A particle size between about 100 Angstroms and about 500 Angstroms has been found most suitable for light sources having a wavelength greater than about 4,000 Angstroms. The particle size of the charge injection enabling fullerene particles of the present invention may be controlled by the preparative route used to dissolve and/or precipitate the fullerene particles or to form dispersions thereof. By dissolving fullerenes in a solvent followed by fine particle precipitation and film fabrication, higher transparency of the overcoating can be achieved. Unlike ordinary carbon black, fullerene particles may be present in the final coating as a molecular dispersion where the fullerene particles cannot be detected by transmission electron microscopy (TEM).

The components of the overcoating layer may be combined by conventional means. Typical mixing means include stirring rods, ultrasonic vibrators, magnetic stirrers, paint shakers, sand mills, roll pebble mills, sonic mixers, melt mixing devices and the like. It is important, however, that if the insulating film forming binder is a different material than the charge transport molecules, the charge transport molecules must either dissolve in the insulating film forming binder or be capable of being molecularly dispersed in the insulating film forming binder. A solvent or solvent mixture for the film forming binder and charge transport molecules may be utilized if desired. Preferably, the solvent or solvent mixture should dissolve both the insultating film forming binder and the charge transport molecules. If desired, fullerene particles may be precipitated insitu after the coating is applied. Fullerene solubility and precipitation depends on the solvents employed. For example, fullerenes remain in solution in toluene, but as a pigment in tetrahydrofuran. Fullerenes can be made to precipitate in a coating mixture containing toluene and tetrahydrofuran as the coating mixture dries. The solvent selected should not adversely affect the underlying photoreceptor. For example, the solvent selected should not dissolve or crystallize the underlying photoreceptor. Typical solvents that will also dissolve fullernes include, for example, toluene, benzene, xylene, trichlorobenzene, trimethylbenzene and other substituted halo and alkyl benzenes, and the like.

The overcoating mixture may be applied to the photoconductive member or to a blocking layer, if a blocking layer is utilized. The overcoating mixture may be applied by known techniques. Typical coating techniques include all spraying techniques, draw bar coating, dip coating, gravure coating, silk screening, air knife coating, reverse roll coating, extrusion techniques the like. Conventional drying or curing techniques may be utilized to dry the overcoating. The drying or curing conditions should be selected to avoid damaging the underlying photoreceptor. For example, the overcoating drying temperatures should not cause crystallization of amorphous selenium when an amorphous selenium photoreceptor is used.

The thickness of the overcoating layer after drying or curing is preferably between about 1 micrometer and about 15 micrometers. Generally, overcoating thicknesses less than about 1 micrometer fail to provide sufficient protection for the underlying photoreceptor during extended cycling. Greater protection is provided by an overcoating thickness of at least about 3 micrometers. Resolution of the final toner image begins to degrade when the overcoating thickness exceeds about 15 micrometers. Clearer image resolution is obtained with an overcoating thickness less than about 8 micrometers. Thus, an overcoating thickness of between about 3 micrometers and about 8 micrometers is preferred for optimum protection and image resolution.

The final dried or cured overcoating should be substantially electrically insulating prior to charging. Satisfactory results may be achieved when the final overcoating has a resistivity of at least about $10^{11}$ ohm-cm, preferably $10^{13}$ ohm-cm, at fields low enough essentially to eliminate injection from the charge injection enabling fullerene particles into the transport molecule. The overcoating is substantially electrically insulating in the dark. The charge injection enabling particles will therefore not polarize in less than about $10^{-12}$ second and inject charge carriers into the continuous charge transporting phase in less than about 10 microseconds when an electric field less than about 5 volts per micron is applied across the imaging member from the conductive substrate to the outer surface of the overcoating.

The final dried or cured overcoating of the present invention is substantially non-absorbing in the spectral region at which the underlying photoconductive layer or layers are sensitive. The expression "substantially non-absorbing" is defined as a transparency of between about 35 percent and about 90 percent in the spectral region at which the underlying photoconductive layer or layers are sensitive. A transparency of at least about 50 percent in the spectral region at which the underlying photoconductive layer or layers are sensitive is preferred for a balance of electrical and optical properties in the coating speed with optimum speeds being achieved at a transparency of at least greater than 90 percent.

Any suitable electrophotographic imaging member may be overcoated with the overcoating layer of this invention. Generally, an electrophotoconductive member comprises one or more photoconductive layers on a supporting substrate.

The substrate may be opaque or substantially transparent and may comprise numerous suitable materials having the required mechanical properties. Accordingly, this substrate may comprise a layer of a non-conductive or conductive material such as an inorganic or an organic composition. If the substrate comprises non-conductive material, it is usually coated with a conductive composition. As insulating non-conducting materials there may be employed various resins known for this purpose. The insulating or conductive substrate may be flexible or rigid and may have any number of many different configurations such as, for example, a plate, a cylindrical drum, a scroll, an endless flexible belt, and the like.

The thickness of the substrate layer depends on numerous factors, including economical considerations, and thus this layer may be of substantial thickness, for example, over 200 microns, or of minimum thickness less than 50 microns, provided there are no adverse affects on the final photoconductive device.

A conductive layer or ground plane which may comprise the entire support or be present as a coating on a non-conductive layer and may comprise any suitable material including, metals, carbon black, graphite and the like. The conductive layer may vary in thickness over substantially wide ranges depending on the desired use of the electrophotographic member. Accordingly, the conductive layer can generally range in thickness of from about 50 Angstroms to many centimeters. These conductive layers are well known and described, for example in U.S. Pat. No. 4,515,882.

Any suitable photoconductive layer or layers may be overcoated with the overcoating layer of this invention. The photoconductive layer or layers may be inorganic or organic. Typical inorganic photoconductive materials include well known materials such as amorphous selenium, selenium alloys, halogen-doped selenium alloys such as selenium-tellurium, selenium-tellurium-arsenic, selenium-arsenic, and the like, cadmium sulfoselenide, cadmium selenide, cadmium sulfide, zinc oxide, titanium dioxide and the like. Typical organic photoconductors include phthalocyanines, quinacridones, pyrazolones, polyvinylcarbazole-2,4,7-trinitrofluorenone, anthracene and the like. Many organic photoconductors may be used as particles dispersed in a resin binder. These photoconductive layers are well known and described, for example in U.S. Pat. No. 4,515,882.

Any suitable multilayer photoconductors may also be employed with the overcoating layer of this invention. The multilayer photoconductors comprise at least two electrically operative layers, a photogenerating or charge generating layer and a charge transport layer. Examples of photogenerating layers include trigonal selenium, various phthalocyanine pigments such as the X-form of metal free phthalocyanine, metal phthalocyanines such as copper or titanyl phthalocyanine, quinacridones, substituted 2,4-diamino-triazines, polynuclear aromatic quinones, benzimidazole perylene, and the like. Examples of photosensitive members having at least two electrically operative layers include the charge generating layer and diamine containing transport layer members disclosed, for example, in U.S. Pat. No. 4,254,990. Other combinations of electrically operative layer materials are well known and disclosed, for example in U.S. Pat. Nos. 4,515,882, 3,895,944 and 3,837,851. The photogenerating layer containing photoconductive compositions and/or pigments and the resinous binder material generally ranges in thickness between about 0.1 micrometer and about 5 micrometers, and preferably has a thickness of between about 0.3 micrometer to about 1 micrometer. Thicknesses outside these ranges can be selected providing the objectives of the present invention are achieved.

Numerous inactive resin materials may be employed in the charge transport layer including those described, for example, in U.S. Pat. No. 3,121,006. The resinous binder for the charge transport layer may be identical to the resinous binder material employed in the charge generating layer. Typical organic resinous binders include thermoplastic and thermosetting resins such as polycarbonates, polyesters, polyamides, polyurethanes, polystyrenes, polyarylethers, polyarylsulfones, polybutadienes, and many others as described, for example in U.S. Pat. No. 4,515,882. These polymers may be block, random or alternating copolymers.

Generally, the thickness of the transport layer is between about 5 micrometers and about 100 micrometers, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1, and in some instances as great as 400:1.

A preferred multilayered photoconductor comprises a charge generating layer comprising a layer of photoconductive material and a contiguous charge transport layer of a polycarbonate resin material having a molecular weight of from about 20,000 to about 120,000 having dispersed therein from about 25 to about 75 percent by weight of one or more arylamines as described in U.S. Pat. No. 4,515,882. The photoconductive layer exhibits the capability of photogeneration of holes and injection of the holes. The charge transport layer is substantially non-absorbing in the spectral region at which the photoconductive layer generates and injects photogenerated holes from the photoconductive layer and transports the holes through the charge transport layer.

In the device described in U.S. Pat. No. 4,515,882, sensitivity of the photoreceptor is affected by absorption and scattering of some of the activating radiation absorbed by the components of the overcoating. Grinding of charge injection enabling particle to a small size for improved overcoating transparency is an extra processing step and very small particle sizes are difficult to achieve by grinding. Carbon black pigment is one of the charge injection enabling species described in U.S. Pat. No. 4,515,882. However, high light absorption and scattering due to carbon pigment particle size and loading in the overcoating reduces photoreceptor photosensitivity. For example, one weight percent of carbon black pigment, which is a prime charge injection enabling species in U.S. Pat. No. 4,515,882, reduces light transmission to the photosensitive layer by about 20 percent.

The overcoating of this invention is especially effective in prolonging the life of electrophotographic imaging members having a supporting substrate, a charge transport layer and a thin charge generating layer. Without an overcoating, even slight wear of thin charge generating layers can dramatically change the electrical characteristics of an electrophotographic imaging member and significantly curtail cycling life. Also, the overcoatings of the present invention may also reduce emission of any toxic Se, Te and As particles generated from alloy photoreceptors of xerographic machines used in making copies. They may also inhibit crystallization of selenium/tellurium alloys by chemical exposure to, e.g., mercury vapor in dental offices. Further, the overcoatings prevent extraction of charge transport molecules from layered photoreceptors when used with liquid developers.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A coating composition was prepared containing a solids mixture of 60 weight percent of a polycarbonate [poly(4,4'-diphenyl-1,1'-cyclohexane carbonate)] resin and 40 weight percent N,N'-diphenyl-N,N'-bis(3-methylphenyl)-(1,1'-biphenyl]-4,4'-diamine) dissolved in 90 grams of toluene solvent to produce a 10 weight percent solution. This coating composition was coated on an aluminum sheet by using a wet film bar applicator. The coating composition was applied to smooth aluminum sheets by means of a Gardner Draw Bar Coater (available from Pacific Scientific) equipped with a coating bar with a 0.002 inch gap and dried in a forced air oven at about 100° C. for about 30 minutes to form coatings containing the diamine dissolved in the polycarbonate resin binder with various concentrations of fullerene or carbon black pigment (if present) uniformly dispersed throughout the deposited coating to form coatings having a dry thickness of 3.3 micrometers. Charge was applied to the coated sheet by corona discharge using a constant voltage of ±5,000 volts. The charge level, dark decay and residual voltage were determined by a laboratory electrostatic scanning device consisting of a Monroe Model 152A corotron power supply, Keithley 610C Electrometer and Hewlet Packard 7402A Recorder. The overcoated sample was mechanically moved under the corotron to deposite charge and then under an electrometer probe to measure the charge on the surface, decay rate and residual voltage. Measurement of the charged sheet with the Keithly 610C electrometer showed that the coated sheet was electrically insulative with a charge retention of about −191 V/μm and +124 V/μm.

EXAMPLE II

The procedures described in Example I were repeated with the same materials except that about 1 weight percent of a mixed fullerene of $C_{60}$ and $C_{70}$ fullerenes available from from Texas Fullerenes Corporation based on the total weight of solids of the polycarbonate and diamine was added to the coating solution. The fullerene had an average particle size of less than about 0.01 micrometer. After formation of the dried coating and charging, the charge acceptance of the modified layer was about −64 V/μm and +67 V/μm. This was less than that measured for the coated sheet of Example I.

EXAMPLE III

Another coating composition identical to that described in Example II was applied to clear polyethylene terephthalate film and the optical transmission of the dried coating was determined by the use of a densitometer made by Brumac Industries. The instrument was first calibrated using a photographic step table and the percent transmission thereafter measured. The percent transmission was about 94 percent.

EXAMPLE IV

Another coating composition was prepared identical to that described in Example II except that ordinary carbon black pigment having an average particle size of about 0.13 micrometer was substituted for the fullerene. This coating composition was applied to clear polyethylene terephthalate film and the optical transmission of the dried coating was measured as described in Example III. The transmission was about 85 percent.

EXAMPLE V

The procedures described in Example I were repeated with the same materials except that the N,N'-diphenyl-N,N'-bis(3-methylyphenyl)-(1,1'-biphenyl]-4,4'-diamine) was omitted and about 1 weight percent of fullerene described in Example II, based on the total weight of solids was added to the coating solution. This coating composition was coated on an aluminum sheet as described in Example I and dried to form a coating having a dry thickness of 5.3 micrometers. Charge was applied to the coated sheet by corona discharge using a constant voltage of ±5,000 volts. Measurement of the charged sheet with a Keithly 610C electrometer showed that the coating was insulative and that N,N'-diphenyl-N,N'-bis(3-methylyphenyl)-(1,1'-biphenyl]-4,4'-diamine) was required for charge transport.

EXAMPLE VI

The procedures described in Example II were repeated with the same materials except that the initial fullerene solution contained 2 weight percent fullerene instead of 1 weight percent fullerene. This coating composition was coated on an aluminum sheet as described in Example II and dried to form a coating having a dry thickness of 3.3 micrometers. Charge was applied to the coated sheet by corona discharge using a constant voltage of ±5,000 volts. Measurement of the charged sheet with a Keithly 610C electrometer showed that the coated sheet was electrically insulative with a charge retention of about −188 V/μm and +70 V/μm.

EXAMPLE VII

The procedures described in Example II were repeated with the same materials except that the initial fullerene solution contained 3.8 weight percent fullerene instead of 1 weight percent fullerene. This coating composition was coated on an aluminum sheet as described in Example II and dried to form a coating having a dry thickness of 1.3 micrometers. Charge was applied to the coated sheet by corona discharge using a constant voltage of ±5,000 volts. Measurement of the charged sheet with a Keithly 610C electrometer showed that the coated sheet was electrically insulative with a charge retention of about −107 V/μm and +68 V/μm. The coatings described in Examples II, III, V, VI, and VII are useful as overcoatings for positive charging multilayered photoreceptors.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising at least one photoconductive layer and an overcoating layer comprising an insulating film forming continuous phase comprising charge transport molecules and charge injection enabling sites comprising finely divided fullerene particles dissolved or dispersed in said continuous phase, said fullerene particles being a different material than said charge transport molecules, and said overcoating layer being substantially transparent to activating radiation to which said photoconductive layer is sensitive and substantially electrically insulating at low electrical fields.

2. An electrophotographic imaging member according to claim 1 including a blocking layer interposed between said photoconductive layer and said overcoating layer.

3. An electrophotographic imaging member according to claim 1 wherein said fullerene particles have an average particle size less than about 25 micrometers and less than the wavelength of light to which said photoconductive layer is sensitive.

4. An electrophotographic imaging member according to claim 1 wherein said fullerene particles have an average particle size less than about 1 micrometer and less than the wavelength of light to which said photoconductive layer is sensitive.

5. An electrophotographic imaging member according to claim 1 wherein said fullerene particles have an average particle size between about 100 angstroms and about 500 angstroms and less than the wavelength of light to which said photoconductive layer is sensitive.

6. An electrophotographic imaging member according to claim 1 wherein said continuous phase comprises an insulating film forming binder having said charge transport molecules molecularly dispersed therein.

7. An electrophotographic imaging member according to claim 1 wherein said continuous phase comprises an electrically insulating charge transporting film forming binder.

8. An electrophotographic imaging member according to claim 1 wherein said fullerene comprises $C_{60}$ carbon.

9. An electrophotographic imaging member according to claim 1 wherein said fullerene comprises $C_{60}$ carbon in the configuration of a soccer ball.

10. An electrophotographic imaging member according to claim 1 wherein said fullerene is selected from the group consisting of $C_{60}$ carbon, $C_{70}$ carbon, $C_{76}$ carbon, $C_{82}$ carbon, $C_{84}$ carbon $C_{88}$, carbon, $C_{90}$ carbon, $C_{96}$ carbon, $C_{234}$ carbon, $C_{340}$ carbon, or mixtures thereof.

11. An electrophotographic imaging member according to claim 1 wherein said fullerene has a molecular weight between about 384 and about 12,000.

12. An electrophotographic imaging member according to claim 1 wherein said overcoating layer comprises between about 0.1 weight percent and about 25 weight percent of said fullerene based on the total weight of said overcoating layer.

13. An electrophotographic imaging member according to claim 1 wherein said charge transport molecules comprise an arylamine compound.

14. An electrophotographic imaging member according to claim 1 wherein said overcoating layer has a resistivity greater than about $10^{11}$ ohm-cm

15. An electrophotographic imaging member according to claim 1 wherein said overcoating layer has a thickness between about 1 micrometer and about 15 micrometers.

16. An electrophotographic imaging member according to claim 1 wherein said overcoating layer has a transparency of at least about 35 percent.

17. An electrophotographic imaging member according to claim 1 wherein said overcoating layer has a transparency of at least about 90 percent.

18. An electrophotographic imaging process comprising (a) providing an electrophotographic imaging member comprising at least one photoconductive layer and an overcoating layer comprising an insulating film forming continuous phase comprising charge transport molecules and charge injection enabling sites finely divided comprising fullerene particles dissolved or dispersed in said continuous phase, said fullerene particles being a different material than said charge transport molecules, and said overcoating layer having a thickness between about 1 micrometer and about 15 micrometers and being substantially transparent to activating radiation to which said photoconductive layer is sensitive and having an imaging surface spaced from said photoconductive layer, (b) contacting the side of said photoconductive layer spaced from said overcoating layer with a conductive substrate, (c) depositing in the dark a substantially uniform electrostatic charge on said imaging surface, and (d) applying a sufficient electric field across said electrophotographic imaging member to polarize said charge injection enabling particles whereby said charge injection enabling particles inject charge carriers into said continuous phase, said charge carriers are transported in the dark to and trapped at the interface between said photoconductive layer and said overcoating layer, and opposite space charge in said overcoating layer is relaxed by charge emission from said charge injection enabling particles to said imaging surface.

19. An electrophotographic imaging process according to claim 18 wherein said charge carriers are trapped at a blocking layer interposed between said photoconductive layer and said overcoating layer.

20. An electrophotographic imaging process according to claim 18 wherein said overcoating layer is electrically insulating prior to and after said injection enabling particles inject charge carriers into said continuous phase and said charge carriers are transported in the dark to and trapped at the interface between said photoconductive layer and said overcoating layer.

* * * * *